US005137542A

United States Patent [19]

Buchanan et al.

[11] Patent Number: 5,137,542

[45] Date of Patent: Aug. 11, 1992

[54] ABRASIVE PRINTED WITH AN ELECTRICALLY CONDUCTIVE INK

[75] Inventors: Scott J. Buchanan; Kwo-Dong A. Chang, both of St. Paul, Minn.

[73] Assignee: Minnesota Mining and Manufacturing Company, St. Paul, Minn.

[21] Appl. No.: 592,223

[22] Filed: Oct. 9, 1990

Related U.S. Application Data

[63] Continuation-in-part of Ser. No. 564,715, Aug. 8, 1990.

[51] Int. Cl.[5] ..... B24D 11/00

[52] U.S. Cl. ..... 51/295; 51/293; 51/298; 51/307; 51/308; 51/309; 252/502; 252/511

[58] Field of Search ..... 51/293, 295, 298, 307, 51/308, 309; 252/502, 511

[56] References Cited

U.S. PATENT DOCUMENTS

| | | | |
|---|---|---|---|
| 2,440,300 | 4/1948 | Rushmer et al. | 51/298 |
| 2,509,652 | 5/1950 | Rushmer et al. | 18/47.5 |
| 3,163,968 | 1/1965 | Nafus | 51/394 |
| 3,168,387 | 2/1965 | Adams | 51/295 |
| 3,377,264 | 4/1968 | Duke et al. | 204/290 |
| 3,942,959 | 3/1976 | Markoo et al. | 51/295 |
| 3,992,178 | 11/1976 | Markoo et al. | 51/295 |
| 4,240,807 | 12/1980 | Kronzer | 51/295 |
| 4,317,660 | 3/1982 | Kramis et al. | 51/295 |
| 4,441,894 | 4/1984 | Sarin et al. | 51/293 |
| 4,457,766 | 7/1984 | Caul | 51/298 |
| 4,469,489 | 9/1984 | Sarin et al. | 51/309 |
| 4,547,204 | 10/1985 | Caul | 51/298 |
| 4,576,612 | 3/1986 | Shukla et al. | 51/295 |
| 4,588,419 | 5/1986 | Caul et al. | 51/295 |
| 4,652,274 | 3/1987 | Boettcher et al. | 51/298 |
| 4,689,242 | 8/1987 | Pike | 51/295 |
| 4,751,138 | 6/1988 | Turney et al. | 51/295 |
| 4,988,554 | 1/1991 | Peterson et al. | 51/295 |

FOREIGN PATENT DOCUMENTS

| | | |
|---|---|---|
| 54-152197 | 11/1979 | Japan . |
| 58-171264 | 10/1983 | Japan . |
| 61-152373 | 7/1986 | Japan . |
| 885192 | 12/1961 | United Kingdom . |
| 2018811 | 10/1979 | United Kingdom . |

*Primary Examiner*—William R. Dixon, Jr.
*Assistant Examiner*—Willie J. Thompson
*Attorney, Agent, or Firm*—Gary L. Griswold; Walter N. Kirn; Richard Francis

[57] ABSTRACT

A coated abrasive article having a printed coating of electrically conductive ink incorporated in the construction thereof, such that the buildup of static electricity during the use of the article is either reduced or eliminated. In another respect, a method to make the same is taught.

45 Claims, 2 Drawing Sheets

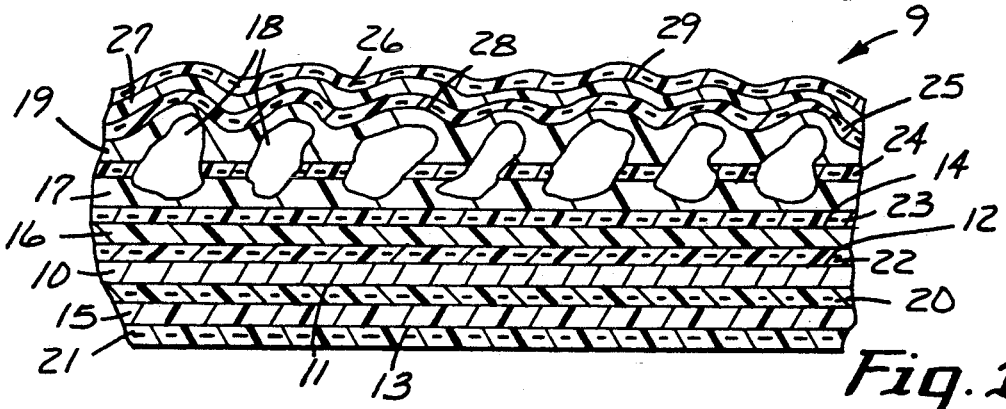
Fig. 1
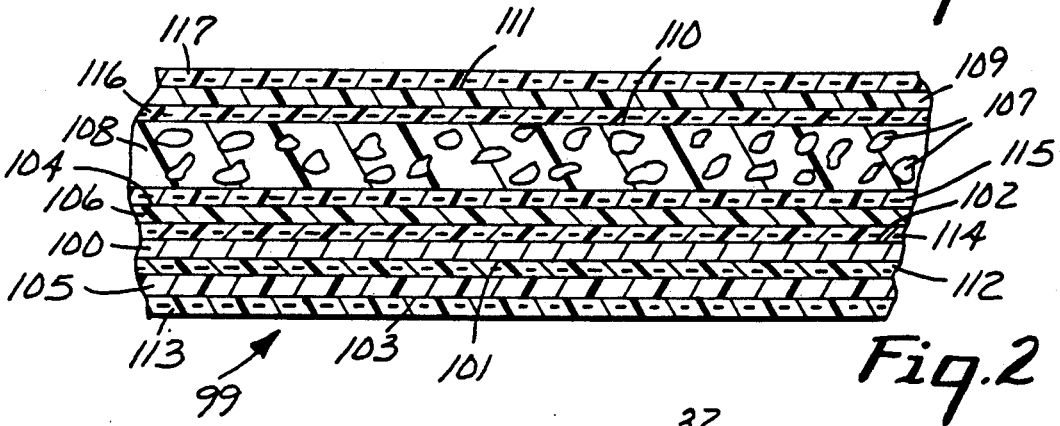
Fig. 2
Fig. 3
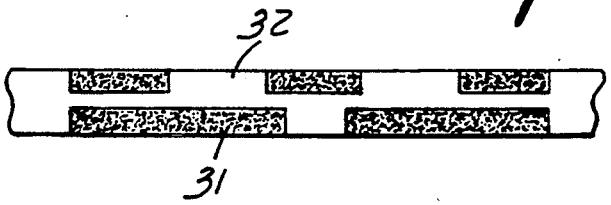
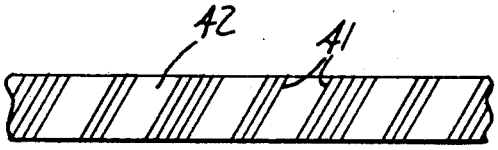
Fig. 4
Fig. 5
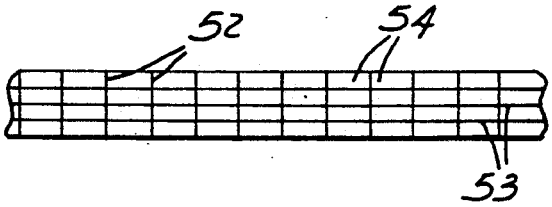
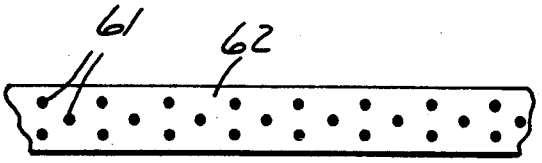
Fig. 6

ABRASIVE PRINTED WITH AN ELECTRICALLY CONDUCTIVE INK

This is a continuation-in-part of application Ser. No. 07/564,715, filed Aug. 8, 1990.

FIELD OF THE INVENTION

This invention pertains to coated abrasive products having a printed coating of electrically conductive ink and a method of making the same.

BACKGROUND ART

Coated abrasives, considered the premier tool for abrading and finishing wood and wood-like materials, unfortunately suffer from the generation of static electricity curing their use. Static electricity is generated by the constant separation of the abrasive product from the workpiece and the machinery support for this abrasive product. This static charge is typically on the order of 50 to 100 kilovolts.

Static electricity is responsible for numerous problems. For example, a sudden discharge of the accumulated static charge can cause injury to an operator in the form of an electrical shock or can ignite wood dust particles, which poses a serious threat of fire or explosion. The static charge also causes the sawdust to cling to various surfaces, including that of the coated abrasive, the abrading machine, and the electrically nonconductive wood workpiece, thereby making it difficult to remove by use of a conventional exhaust system.

If the static electrical charge is reduced or eliminated, the coated abrasive can have a significantly longer useful life and the potential for the above-mentioned hazards can be eliminated or reduced.

Many attempts, with varying degrees of success, have been made to solve the static electricity problem. One common approach has been to incorporate an electrically conductive or antistatic material into the coated abrasive construction to eliminate the accumulation of electrical charge.

For example, U.S. Pat. No. 3,163,968 (Nafus) discloses a coated abrasive article having a coating comprising graphite on the surface opposite the abrasive material. U.S. Pat. No. 3,168,387 (Adams) discloses a coated abrasive having metal leaf pigment over the abrasive grains. U.S. Pat. No. 3,377,264 (Duke) discloses an electrically conductive layer such as a metal foil, overlying the front surface of a coated abrasive.

U.S. Pat. No. 3,942,959 (Markoo et al.) teaches a coated abrasive construction having an electrically conductive resin layer sandwiched between two electrically nonconductive resin layers to prevent the accumulation of electrostatic charge during grinding. In the latter construction, the resin layer is made electrically conductive by incorporating into the resin an electrically conductive filler which may be a metal alloy, metal pigment, metal salt or metal complex. Further, Markoo et al. conclude that in order for the electrically conductive layer to have the desired anti-electrostatic effect, it is essential that the layer not be in direct contact with the support member of the abrading machine employed.

U.S. Pat. No. 3,992,178 (Markoo et al.) discloses a coated abrasive article having an outer layer comprised of graphite particles in a bonding resin which reduces the electrostatic charges generated during grinding.

U.S. Pat. No. 5,061,294 (Harmer et al.) assigned to the assignee of the present application teaches a coated abrasive that is rendered conductive by the addition of a doped conjugated polymer.

U.S. patent application Ser. No. 07/551,091, filed Jul. 16, 1990 as a continuation-in-part of U.S. patent application Ser. No. 07/495,458, filed Mar. 16, 1990, which in turn is a continuation-in-part of U.S. patent application Ser. No. 07/396,513, filed Aug. 21, 1989 (Buchanan) assigned to the assignee of the present application, discloses including carbon black aggregates in the coated abrasive bond system. The presence of the carbon black aggregates reduces the buildup of static electricity generated during abrading.

While at least some of these references provide a solution to the static electricity problem, none provides the more convenient solution of the present invention.

SUMMARY OF THE INVENTION

The present invention provides a coated abrasive article which has a coating of a cured electrically conductive ink printed on the back surface of the backing, the front surface of the backing, the top surface of the abrasive layer or component layer thereof, or a combination thereof, wherein the cured electrically conductive ink comprises a sufficient amount of electrically conductive material to reduce or eliminate the static electrical problems associated with conventional coated abrasives during the abrading of electrically insulating workpieces (i.e., workpieces having an electrical surface resistivity of greater than about $10^{11}$ ohms/square). Such electrically insulating workpieces may be made, for example, of wood (e.g., pine, oak, cherry, etc.), plastic, mineral (e.g., marble), or the like (e.g., particle board or pressed board). A method of making the coated abrasive is also provided.

The coating of cured electrically conductive ink printed on the back surface or the front surface can be a continuous coating, a non-continuous pattern coating, or a combination thereof. The coating of cured electrically conductive ink printed on the top surface of the abrasive layer or a component layer thereof is a non-connected pattern coating.

A "continuous" printed coating covers a surface without interruption. A "non-continuous" printed pattern coating has printed areas and unprinted areas. Non-continuous printed pattern coatings may include parts Which have areas of continuity as in the case of a checkered pattern (i.e., made by parallel lines in both the machine and the cross machine direction) or negative indicia.

A "non-connected" printed pattern coating is a non-continuous pattern which has unconnected areas or "islands" (e.g., dots, squares, rectangles, triangles, diamonds, or other geometric shapes) of printed material separated by unprinted areas. Other examples of non-connected patterns include stripes, positive indicia, (e.g., trade name of product), symbols (e.g., letters, numbers, etc.), the like, and combinations thereof.

The printed pattern coatings according to the present invention can be repeating or non-repeating.

The term "front surface" as used herein refers to the untreated front surface of the backing or the treated front surface of the backing (i.e., the front surface of the backing having a saturant, the front surface of the backing having a presize, etc.).

The term "back surface" as used herein refers to the untreated back surface of the backing or the treated back surface of the backing (i.e., the back surface of the backing having a saturant, the back surface of the backing having a backsize, etc.).

The term "back side" as used herein refers to the back surface of the backing.

The term "top surface" as used herein refers to the outermost surface of the abrasive layer or the outermost surface of a component layer of the abrasive layer (i.e., a make layer, a slurry layer, a size layer, a supersize layer, etc.).

The term "exposed back surface" as used herein refers to the outermost surface of the back side of the backing.

The term "printing" as used herein refers to any appropriate means for applying a coating of a cured electrically conductive ink, including, for example, letter press printing, lithographic printing, gravure printing, screen printing, spray coating, die coating, slide coating, and roll coating, and the term "printed" refers to the coating obtained by use of such means. Means for applying a cured electrically conductive ink may also be provided by electrostatically depositing and fixing or fusing toner particles which comprise electroconductive material.

The coated abrasive may be in any conventional form including those having an abrasive layer comprising a make layer, abrasive grain, a size layer, etc., and other functional layers (e.g., a supersize layer) and those having a monolayer as an abrasive layer comprising a slurry layer comprising a bond system and abrasive grain, and other functional layers. The backing of the coated abrasive optionally has a presize coating, a backsize coating, a saturant, the like, or combinations thereof.

Specifically, the inventive article is a coated abrasive with a reduced tendency to accumulate static electric charge during the abrading of an electrically insulating workpiece, the coated abrasive article having (a) a backing having a front surface and a back surface; and (b) an abrasive layer bonded to the front surface of the backing, the abrasive layer comprising abrasive grain and a layer(s) selected from the group consisting of a make layer and a size layer; a make layer, a size layer, and a supersize layer; a slurry layer; and a slurry layer and a supersize layer, wherein each of the make layer, the size layer, the slurry layer, and the supersize layer have a top surface, the improvement comprising at least one of (i) a pattern coating of a cured electrically conductive ink printed onto at least one of the back surface of the backing, the front surface of the backing, the top surface of the make layer, the top surface of the size layer, the top surface of the slurry layer, and the top surface of the supersize layer;

(ii) a continuous coating of electrically conductive ink printed onto the back surface of the backing; and (iii) a continuous coating of electrically conductive ink printed onto the front surface of the backing, wherein areas of the pattern are non-continuous if the pattern is applied to the back surface of the backing or the front surface of the backing, otherwise the areas of the pattern are non-connected, the cured electrically conductive inks comprising a sufficient amount of electrically conductive material to reduce accumulation of static electric charge during the abrading of an electrically insulating workpiece, with the proviso that the amount of electrically conductive material in any single continuous coating of electrically conductive ink is less than 5 $g/m^2$.

The coated abrasive of the invention may be made by a method which has the steps of:

(a) selecting a backing having a front surface and a back surface; and (b) applying an abrasive layer to the front surface of the backing, the abrasive layer comprising abrasive grain and a layer(s) selected from the group consisting of a make layer and a size layer; a make layer, a size layer, and a supersize layer; a slurry layer; and a slurry layer and a supersize layer, wherein each of the make layer, the size layer, the slurry layer, and the supersize layer have a top surface, the improvement comprising (c) applying at least one of (i) a pattern of a coatable electrically conductive ink to at least one of the back surface of the backing, the front surface of the backing, the top surface of the make layer, the top surface of the size layer, the top surface of the slurry layer, and the top surface of the supersize layer;

(ii) a continuous coating of the coatable electrically conductive ink to the back surface of the backing; and (iii) a continuous coating of the coatable electrically conductive ink to the front surface of the backing, wherein areas of the pattern are non-continuous if the pattern is applied to the back surface of the backing or the front surface of the backing, otherwise the areas of the pattern are non-connected, and wherein the coatable electrically conductive ink comprises a sufficient amount of electrically conductive material to provide upon curing a coated abrasive article having a reduced tendency to accommodate static electric charge during the abrading of an electrically insulating workpiece; and (d) curing the electrically conductive inks to provide a coated abrasive having a reduced tendency to accumulate static electric charge during the abrading of an electrically insulating workpiece, with the proviso that the amount of electrically conductive material in any single continuous coating of electrically conductive ink is less than 5 $g/m^2$.

Preferably, the cured electrically conductive ink pattern coating is printed onto the outermost top surface of the abrasive layer. More preferably, the cured electrically conductive pattern coating is printed onto the back surface of the backing.

The continuous coating of cured electrically conductive ink can be printed onto the front surface of the backing, the back surface of the backing, or both. Preferably, the continuous coating of cured electrically conductive ink is printed onto the exposed back surface of the backing.

A contrasting indicia may be printed over the continuous coating of cured electrically conductive ink printed onto the exposed back surface of the backing.

The term "coatable electrically conductive ink" as used herein refers to a liquid or liquifiable dispersion comprising an electrically conductive pigment material and a liquid or liquifiable curable medium (e.g., solvent, resin, polymer precursor, the like, or compatible combination thereof). The term "cured electrically conductive ink" as used herein refers to a coatable electrically conductive ink which has been cured. The term "curing" as used herein in regard to the electrically conductive ink coating of the present invention refers to any appropriate drying, curing, solidification, evaporation of solvent, etc., required to convert the coatable electrically conductive ink to a dry, preferably non-tacky state.

Examples of electrically conductive materials comprising the electrically conductive ink according to the present invention include graphite, carbon black, metals, metal alloys, and mixtures thereof.

In contrast to a structural layer of the coated abrasive article (i.e., presize, backsize, saturant, make layer, slurry layer, size layer, etc.), the cured electrically conductive ink of the present invention is non-structural (i.e., it does not significantly affect the tensile strength, stretch characteristics, or stiffness/flexibility of the coated abrasive article). Preferably, the equivalent planar thickness of the cured electrically conductive ink is less than 10 micrometers. More preferably, the equivalent planar thickness of the cured electrically conductive ink is less than 4 micrometers.

For a coated abrasive having the inventive coating on the exposed back surface, it is preferable that any transfer of the cured electrically conductive ink from the back side of the coated abrasive to the idler rolls of the sanding machine during use be minimized.

The present invention provides a coated abrasive article which provides a solution to the serious static electricity build-up problem associated with abrading an electrically insulating workpiece with a coated abrasive article.

BRIEF DESCRIPTION OF THE DRAWINGS

FIGS. 1-2 are enlarged cross sectional views of various embodiments of coated abrasive products made in accordance with the present invention.

FIGS. 3-8 are top views of various coated abrasive products in accordance with the present invention each having thereon a different printed electrically conductive ink pattern coating.

DETAILED DESCRIPTION OF PREFERRED EMBODIMENTS

Figure 7:
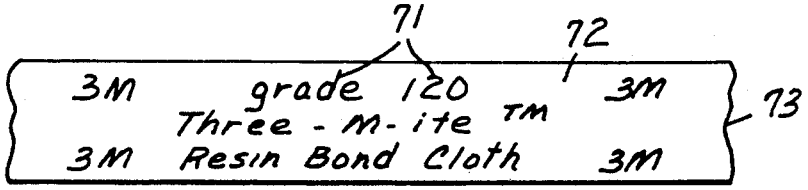

This invention pertains to a coated abrasive product which has at least one of a continuous coating of cured electrically conductive ink printed on the back surface of the backing, the front surface of the backing, or both; a non-continuous cured electrically conductive ink pattern coating printed on the back surface of the backing, the front surface of the backing, or both; and a non-connected cured electrically conductive ink pattern coating printed on the top surface of the abrasive layer, the top surface of at least one component layer of the abrasive layer, or a combination thereof.

In general, the coated abrasive product of the present invention comprises a backing which has a front surface and a back surface, and an abrasive layer which comprises a plurality of abrasive grains which are secured to the backing by a bond system. Optionally, the abrasive layer may further comprise other functional layers (e.g., a supersize layer).

The coated abrasive of the present invention may take any of a variety of embodiments, as will be explained below.

Referring to FIG. 1, coated abrasive 9 comprises backing 10 having plurality of abrasive grains 18 bonded to backing 10 by means of a bond system which typically consists of first bond coat 17 (generally referred to as a "make" coat or "make" layer) and second bond coat 19 (generally referred to as a "size" coat or "size" layer). Make coat 17 secures abrasive grains 18 to backing 10 and size coat 19 further reinforces abrasive grains 18. Coated abrasive 9 optionally includes any one of back size coat 15 on back surface 11 of backing 10, presize coat 16 on front surface 12 of backing 10, and third adhesive coat 27 (generally referred to as a "supersize" coat or "supersize" layer) over size coat 19.

Cured electrically conductive ink coat 20, 21, 22, or 23, which can be continuous, non-continuous, or a combination thereof, can be present on back surface 11 of backing 10, on back size surface 13 of back size coat 15, on front surface 12 of backing 10, or on presize surface 14 of presize coat 16, respectively.

Non-connected cured electrically conductive ink pattern coat 24, 25, or 26 can be present on top surface 30 of make coat 17, on top surface 28 of size coat 19, or on top surface 29 of supersize coat 27, respectively. Alternatively, coat 15 and coat 16 collectively represent a saturant, which is optionally present, surface 13 represents the back surface of saturant 15, and surface 14 represents the front surface of saturant 16.

While coats 20-26 are all shown in the coated abrasive 9 depicted in FIG. 1, it is typical to only have one of coats 20-26 in such a coated abrasive product.

FIG. 2 shows lapping abrasive 99 according to the invention which comprises backing 100 having plurality of abrasive grains 107 dispersed throughout bond system 108. Coated abrasive 99 optionally includes any one of back size coat 105 on back surface 101 of backing 100, presize coat 106 on front surface 102 of backing 100, and supersize coat 109 on top surface 110 of bond system 108.

Cured electrically conductive coat 112, 113, 114, or 115, which can be continuous, non-continuous, or a combination thereof, can be present on back surface 101 of backing 100, on back size surface 103 of back size coat 105, on front surface 102 of backing 100, or on presize surface 104 of presize coat 106.

Non-connected cured electrically conductive ink pattern coat 116 or 117 can be present on top surface 110 of bond system 108 and abrasive grains 107, and on top surface 111 of supersize coat 109, respectively. Alternatively, coat 105 and coat 106 collectively represent a saturant, surface 103 represents the back surface of saturant 105, and surface 104 represents the front surface of saturant 106.

While coats 112-117 are all shown in the coated abrasive 99 depicted in FIG. 2, it is typical to only have one of coats 112-117 in such a coated abrasive product.

Backing materials forming the coated abrasives of the present invention may be selected from any materials which are known for such use including, for example, paper, polymeric film, fiber, cloth, treated versions thereof, or combinations thereof. For a lapping abrasive the preferred backing is a polymeric film, such as, for example, a polyester film.

The backing may be treated (i.e., having a presize coating, a backsize coat, a saturant, or combinations thereof. Presize, backsize and saturant materials are known in the art and include, for example, glue, phenolic resins, latices, epoxy resins, the like, or combinations thereof.

The abrasive grains are also conventional and may for example be selected from such known grains as fused aluminum oxide, heat-treated aluminum oxide, ceramic aluminum oxide, cofused alumina-zirconia, garnet, silicon carbide, diamond, cubic boron nitride, and combinations thereof.

The preferred bond system is a resinous or glutinous adhesive. Examples of typical resinous adhesives include phenolic resins, urea-formaldehyde resins, melamine-formaldehyde resin, epoxy resins, acrylate resins, urethane resins, and combinations thereof. The bond system may contain other additives which are well known in the art, such as grinding aids, plasticizers, fillers, coupling agents, wetting agents, dyes, and pigments.

The coated abrasive product may also contain supersize coat 27 as shown in FIG. 1. The purpose of the supersize coat is to reduce the amount of loading. "Loading" is the term used to describe the filling of the spaces between abrasive grains with swarf (the material removed from the workpiece) and the subsequent build-up of that material. For example, during wood sanding, swarf comprised of wood particles becomes lodged in the spaces between abrasive grains, dramatically reducing the cutting ability of the grains.

Examples of useful materials which may be used in the supersize coat include the metal salts of fatty acids, urea-formaldehyde, novolak phenolic resins, waxes, and mineral oils. The preferred supersize is a metal salt of a fatty acid, such as zinc stearate.

The coatable electrically conductive ink of the invention may comprise an electrically conductive pigment material dispersed throughout a (coatable) curable medium, a coatable dispersion comprising an electrically conductive pigment material dispersed in a solvent (wherein the coatable electrically conductive ink is essentially free of curable medium), the like, or combinations thereof.

Examples of useful electrically conductive pigment materials include carbon black, graphite, metals, metal alloys, or mixtures thereof. Examples of metals include iron, nickel, aluminum, copper, zinc, silver, tin, lead, and the like. Carbon black is the preferred electrically conductive material due its cost and availability. The electrically conductive material is preferably in the form a particulate. If the electrically conductive material is graphite or a metal particulate, the preferred particle size range is between 0.1 micrometer and 10 micrometers. If the electrically conductive material is carbon black, the particle size range is preferably less than one micrometer. If the particle size of the electrically conductive material is too large, it becomes difficult to properly disperse it in the curable medium or solvent. If the particle size is too small, the viscosity of the resulting ink may be too high.

Solvents useful in the present invention include water or an organic solvent, such as, for example, 2-butoxyethanol, toluene, isopropanol, or n-propyl acetate. Preferably, the solvent is selected so that coatable, electrically conductive ink can be dried at a temperature between 20° and 120° C. The preferred solvent is water due to environmental concerns.

Curable media useful in the present invention preferably includes any organic material which is coatable and upon curing forms a film having the electrically conductive material suspended therein and which is adherently bonded to a surface of the coated abrasive (e.g., the back surface of the backing, the front surface of the backing, the top surface of the make layer, the top surface of the size layer, the top surface of the supersize layer, etc.). More preferably, the curable medium is a thermoplastic polymeric or thermoset polymeric material. For a thermoplastic polymeric material, the coatable conductive ink may be rendered coatable by heating to liquify the thermoplastic polymer and cured by permitting the polymer to cool, or the thermoplastic polymer may be dispersed in a liquid vehicle such as water or dissolved in a solvent such as compatible organic solvent and then cured by drying to remove the water or solvent. Preferably, the curable medium is selected so that the coatable conductive ink can be dried at a temperature between 20° and 120° C. for a time sufficient to form the film (typically 5 to 30 minutes).

Examples of useful thermoplastic polymeric curable media include heat bodied linseed oil, alkyd resins, polyesters, polyurethanes, and vinyl polymers. For thermosetting precursor materials, the electrically conductive ink is cured to cause polymerization of the precursor materials to an insoluble, infusible polymer. This is preferably accomplished at a temperature between 60° and 150° C. for 10 to 150 minutes.

Examples of thermosetting precursor materials include epoxy resins, phenolic resins, urea formaldehyde resins, and acrylate resins. For both the thermoplastic polymers and thermosetting precursor materials, the curing time depends upon the coating thickness of the uncured electrically conductive ink, and the air flow above the ink.

Solvent may be added to the curable medium if it is not per se sufficiently liquid and curable without a liquid vehicle. Further, the addition of water or an organic solvent lowers the viscosity of the coatable, curable electrically conductive ink and makes it easier to apply. Typically the coatable, curable electrically conductive ink contains between 50% and 90% by weight water or organic solvent.

For a coatable, curable electrically conductive ink comprising curable medium, it is preferable that the weight ratio of electrically conductive material to the solids content of the curable medium is greater than 1 to 10. More preferably, the weight ratio of electrically conductive material to curable medium is greater than 1 to 1, and even more preferably, it is greater than 4 to 1. The amount of solids present in the curable medium is equivalent to the amount of curable medium remaining after curing.

Preferably, the coatable, curable electrically conductive ink further comprises a dispersion aid which make it easier to disperse the electrically conductive material in the curable medium or solvent. Dispersion aids useful in the present invention include, for example, those commercially available under the trade designations "LOMAR PWA" and "NOPCOSPERSE A-23" from Henkel Corp. of Ambler, Pa. and "DAXAD 11G" from W. R. Grace & Co. of Lexington, Mass.

Examples of commercially available coatable electrically conductive inks include that available under the trade designations "AQUAFLEX ELECTROCONDUCTIVE BLACK OFG-10616" from Sinclair and Valentine, L. P. of Dayton, Ohio and "ELECTRODAG 423SS" and "ELECTRODAG 427SS" from Acheson Colloids Company of Port Huron, Mich.

The addition of the electrically conductive ink coating according the present invention in the construction of the coated abrasive article will cause the coated abrasive to rapidly dissipate static electricity generated during the abrading of an electrically insulating workpiece. When the static electricity is dissipated, the swarf (e.g., wood dust particles) generated for the most part can be removed by the normal exhaust systems. If the static electricity is not dissipated, the swarf tends to become attracted to various adjacent elements because it carries charge, and is not readily removed by a conventional exhaust system.

The art teaches that in order for an abrasive article to have effective anti-static properties, there must be a network of an electrically conductive material between the abrasive grains or a continuous coating of an electrically conductive material on the back side, wherein the continuous coating contains greater than 5 $g/m^2$ of electrically conductive material. The art teaches that this network or continuous coating is needed to eliminate static electricity generated from grinding. Further, the art teaches that the static electricity is generated from the interaction between the platen of a stroke sander and the workpiece being abraded.

The present applicants, however, theorize that the majority of the static electricity generated during abrading is not from the interaction between the platen and the workpiece, but from the interaction of the endless abrasive belt as it traverses over two idler rolls. Applicants have found that during use of the stroke sander (e.g., an Oakley Model D Single selt Stroke Sander) the field strength generated between the backing of the coated abrasive belt and the idler rolls, at a distance of about 2.5 cm (1 inch) from the backing, was about 450 to 3,200 volts per centimeter. This field strength value varies with type of backing, the belt speed, and the width of the belt. The field strength generated between the platen and the workpiece being abraded, at a distance of about 2.5 cm (1 inch) from the backing, was found to be between about 5,000 and 8,250 volts per centimeter. This field strength value varies with the workpiece being abraded. Coated abrasive articles having sufficient electrically conductive material coated thereon dissipate charge locally and not by electrical conduction to the grounded parts of the machine as was previously believed in the art. If the abrasive article does not have sufficient electrically conductive material, static charge quickly builds up during the abrading operation to an equilibrium level. At the equilibrium level, the static electricity dissipates to the air by, in some cases, sending sparks to a ground or by transferring the charge to wood dust particles. If the coated abrasive belt has a coating comprising sufficient electrically conductive material, the static charge dissipates before the abrasive article reaches the next source of static electricity generation, i.e , the interaction between the idler or the workpiece, thus eliminating the static electricity build up during the abrading operation. Applicants have found, quite surprisingly, that this dissipation of static electricity can be accomplished with an abrasive article which has the inventive cured electrically conductive ink coating.

Preferably, the surface resistivity of the cured electrically conductive ink coating according to the present invention is less than 5000 kilo-ohms/square. More preferably, the surface resistivity of the cured electrically conductive ink coating is less than about 2,000 kilo-ohms/square. Even more preferably, it is less than about 1,000 kilo-ohms/square, and most preferably it is less than about 500 kilo-ohms/square. The surface resistivity is measured by placing the probes of an ohmmeter 1.4 cm apart on the printed, cured electrically conductive ink coating.

Examples of appropriate ohmmeters include those available under the trade designations "Beckman Industrial Digital Multimeter", Model 4410 (Beckman Industrial Corp., Brea, Calif.) and "Industrial Development Bangor Surface Resistivity Meter", Model 482 (Bangor Gwynedd, Wales).

Some electrically conductive ink patterns according to the present invention may have a configuration which makes it difficult to measure its surface resistivity. However, when the abrasive article in accordance with the present invention is used, one skilled in the art will readily realize that the cured electrically conductive ink coating is sufficiently electrically conductive because the static electricity will be dissipated.

The coated abrasive product according to the present invention may have at least one of the continuous, non-continuous, and non-connected cured electrically conductive ink pattern coatings. Examples of non-continuous pattern coatings are shown in FIGS. 3–8. The non-continuous pattern coatings of FIGS. 3–4 and 6–7 are also examples of non-connected pattern coatings. The non-continuous pattern coating of electrically conductive ink, for example, may be continuous in the cross direction but not in the machine direction. There may also be a continuous electrically conductive ink coating in the machine direction but not the cross direction.

Referring to FIG. 3, a non-continuous coating has open areas 32 which are uncoated with electrically conductive ink and coated areas 31. FIG. 4 shows a non-continuous coating of stripes with electrically conductive coating strips 41 separated by spaces 42.

FIG. 5 shows a pattern coating of electrically conductive ink formed of vertical lines 52 and horizontal lines 53 with open spaces 54 there between.

Referring to FIG. 6, electrically conductive ink pattern coating of dots 61 is applied on electrically non-conductive field 62.

FIG. 7 depicts a preferred embodiment which includes electrically conductive ink pattern coating of printed information 71 on backing 73, which describes the manufacturer, the product name, and the product grade number on electrically non-conductive field 72. Such a pattern coating allows the user to accurately know which abrasive product he or she is using.

Figure 8:
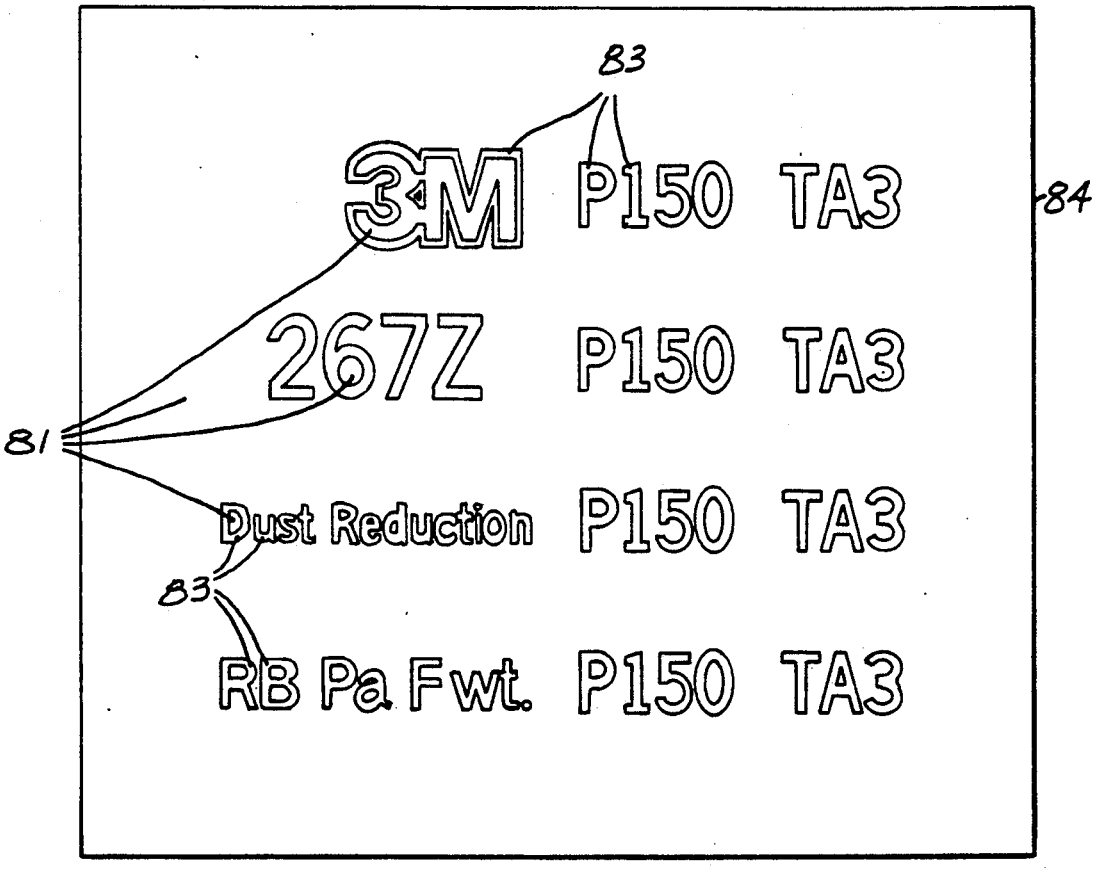

FIG. 8 depicts a more preferred embodiment which includes electrically conductive ink pattern coating 81 on backing 84, leaving electrically non-conductive areas 83. Areas 83 provide information, such as, for example, manufacturer, the product name, and the product grade number.

The patterns illustrated in FIGS. 3 through 8 are not exhaustive of all the potential patterns. They serve to illustrate that a wide variety of different pattern coatings can be applied.

The coatable electrically conductive ink according to the invention can be printed onto the back surface of the backing, the front surface of the backing, the top surface of the abrasive layer, or the top surface of a component layer of the abrasive layer by any of a wide variety of well-known methods, such as, for example, letterpress printing, lithographic printing, gravure printing, screen printing, spray coating, die coating, slide coating, and roll coating.

The preferred coating methods for printing the pattern coating of coatable electrically conductive ink are letterpress printing, lithographic printing, gravure printing, and screen printing. More preferably, the pattern coating is printed by the lithographic printing method.

The preferred methods for printing the continuous coating of coatable electrically conductive ink are spray coating, die coating, slide coating, and roll coating.

Printing by the letterpress printing process is illustrated in FIG. 7. Letterpress printing involves a printing element that consists of a raised surface, wherein the surface can be a line, a word, a point, or any type of figure. In this printing method the coatable electrically conductive ink is applied to the raised surface and then is pressed into the abrasive article to cause the coatable electrically conductive ink to transfer to the article in the specified pattern.

Lithographic printing is also known as offset printing or planographic printing. In this method there is an indirect image transfer. This type of printing technique is illustrated in FIG. 8. The inverse of the printing plate is transferred to the abrasive article.

For gravure printing, a master tool or roll is engraved with minute wells. The coatable electrically conductive ink fills these wells and the excess electrically conductive ink is removed by a doctor blade. The ink in the well is then transferred to an abrasive article. The size and the shape of the well determines the pattern on the abrasive article.

In screen printing, the coatable electrically conductive ink is brushed through a stencil image on a fine screen and then onto a surface of the abrasive article. The stencil image forms the pattern that will ultimately be transferred to the abrasive article. More detailed information on printing techniques can be found in "Printing Inks", Kirth-Othmer Encyclopedia of Chemical Technology, 3rd Ed. 19, 110–163 (1982).

Preferably, the uncured or cured electrically conductive ink coating of the invention contains less than 5 $g/m^2$ of electrically conductive material. More preferably, the uncured or cured electrically conductive ink coating of the invention contains less than 3 $g/m^2$ of electrically conductive material.

With the exception of printing and curing the pattern of inventive coatable electrically conductive ink, coated abrasive articles according to the present invention can be made by conventional techniques known in the art.

In the first preferred conventional method for preparing a (conventional) coated abrasive article, the make coat is applied to the front surface of the backing followed by projecting a plurality of abrasive grains into the make coat. It is preferable in preparing the coated abrasive that the abrasive grains be electrostatically coated. The make coating is cured in a manner sufficient to at least partially solidify such that the size coat can be applied over the abrasive grains. Next, the size coat is applied over the abrasive grains and the make coat. Finally, the make and size coats are fully cured. Optionally, a supersize coat can be applied over the size coat and cured.

In the second preferred convention method for preparing a (conventional) coated abrasive article having a slurry coated abrasive layer, a slurry, which contains abrasive grains dispersed in the bond material is applied to the front surface of the backing. The bond material is then cured. Optionally, a supersize coat can be applied over the slurry coat and cured.

To make the coated abrasive article of the present invention, the inventive cured electrically conductive ink may be incorporated into the abrasive construction during any step of the fabrication process, provided that the application of the ink is compatible with the particular method chosen to make the abrasive article. For example, in preparing a coated abrasive article having a make and size coat, the coatable electrically conductive ink can be printed onto the back surface of an uncoated backing (i.e., a backing without an abrasive layer), the back surface of a finished coated abrasive article, the back surface of a partially finished coated abrasive article, the front surface of the backing, the top surface of the make coat, the top surface of the size coat, the top surface of the supersize coat, the like, or combinations thereof. The uncured electrically conductive ink coating may be cured as needed prior to or during any subsequent processing steps.

In preparing a coated abrasive article having a slurry coat comprising abrasive grain distributed through the bond system, the coatable electrically conductive ink can be printed onto the back surface of an uncoated backing, the back surface of a finished coated abrasive article, the back surface of a partially finished coated abrasive article, the front surface of the backing, the top surface of the abrasive layer, the top surface of the supersize layer, the like, or combinations thereof. The uncured electrically conductive ink may be cured as needed prior to any subsequent processing steps.

In the above methods the make coat, size coat, slurry coat, or uncured electrically conductive ink coat can be solidified or cured by heat or radiation energy depending upon the particular make, size, slurry, or electrically conductive ink coat.

Contrasting indicia can be printed over the continuous coating of cured electrically conductive ink printed on the exposed surface of the backing using any conventional printing means including those disclosed above for printing the coatable electrically conductive ink.

Inks useful for printing the contrasting indicia include those inks known in the art for industrial printing. Such inks are commercially available and include, for example, those commercially available under the trade designations "FA-19138 YELLOW FLEXOGRAPHIC INK" and "FA-8006 BLACK PRINTING INK" from Sinclair & Valentine, St Paul, Minn.

The present invention provides a coated abrasive article which Provides a solution to the serious static electricity build-up problem associated with abrading an electrically insulating workpiece with a coated abrasive article.

A particularly useful embodiment of the present invention provides a coated abrasive product having anti-static properties that is easy to make by employing the cured electrically conductive ink of the present invention on the back side of the backing, instead of the traditional electrically non-conductive ink. Methods disclosed in the art to make a coated abrasive article having anti-static properties require either an extra processing step(s), special processing techniques, or both. The invention does not require any extra processing steps nor any special processing techniques other than the selection of the coatable electrically conductive ink as the ink utilized to print the non-continuous pattern coating on the back side of the backing.

EXAMPLES

Objects and advantages of this invention are further illustrated by the following examples, but the particular materials and amounts thereof recited in these examples, as well as other conditions and details, should not be construed to unduly limit this invention. All parts and percentages are by weight unless otherwise indicated.

Examples 1 to 9 illustrate the effectiveness of coated abrasive articles having the inventive non-continuous electrically conductive ink pattern coating on the back surface of the backing in reducing the buildup of static electricity during the abrading of electrically non-conductive workpieces.

EXAMPLES 1 to 3

Example 1

The following coatable electrically conductive ink dispersion, hereinafter referred to as "Dispersion I," was prepared by thoroughly mixing 6925 grams of a urea-formaldehyde resin (commercially available under the trade designation "DURITE AL-8401" from Borden Chemical of Columbia, Ohio), 450 grams of a 10% aqueous ammonium chloride solution, 1975 grams of water, and 2025 grams of graphite having an average particle size of 5 micrometers (commercially available under the trade designation "#200-09 AIR SPUN GRAPHITE" from the Dixon Ticonderoga Company of Lakehurst, N.J.).

Dispersion I was coated on the back side of an E weight paper backing by pumping the dispersion through a die coater to provide a pattern of continuous stripes of the uncured electrically conductive ink in the machine direction, separated by electrically non-conductive areas. The uncured electrically conductive ink dispersion pattern coating was dried for 2 minutes at 75° C., for 2 minutes at 85° C., and for 2 minutes at 90° C. The cured electrically conductive ink stripes covered about 33% of the backing surface area.

The surface resistivity was measured by placing the probes of an ohmmeter (Beckman Industrial Digital Multimeter, Model 4410, Beckman Industrial Corp., Brea, Calif.) 1.4 cm apart on a cured electrically conductive ink stripe. The surface resistivity value is listed in Table 1.

PROCEDURE FOR MAKING A COATED ABRASIVE

Next, an unfilled phenol resorcinol formaldehyde resin make coat (64% solids) was applied to the front surface (i.e., opposite the back side), of the E weight paper to provide an add-on wet weight of about 46±5 grams/square meter. Immediately thereafter, grade P150 fused aluminum oxide abrasive was electrostatically projected into the make coat to provide an add-on weight of 134±8 grams/square meter. The make coat was precured for 90 minutes at 88° C. in a forced air oven. Next, a calcium carbonate filled resole phenolic resin size coat (76% solids) was coated over the make coat and abrasive grains to provide a wet add-on weight of 59±8 grams/square meter. The make and size coat were then final cured for 10 hours at 100° C. The resulting coated abrasive was then conventionally flexed and rehumidified to prevent the paper from becoming embrittled.

Procedure for Testing the Coated Abrasive

The coated abrasive was then converted into 16 cm by 762 cm endless coated abrasive belts and installed on an Oakley Model D Single Belt Stroke Sander. The coated abrasive belt abraded three red oak workpieces for seven minutes each. The pressure at the interface was approximately 0.20 Newtons/square centimeter. The belt speed corresponded to 1670 surface meters per minute. The amount of red oak removed (cut) was measured and the amount of dust (swarf) collected on a metal plate immediately past the workpiece holder was determined. The amount of red oak removed was divided by the amount of dust collected to generate a dimensionless Dust Efficiency Factor (DEF). High values of the DEF indicate that the production of dust uncollected by the exhaust system was low (i.e., the coated abrasive having the cured electrically conductive ink pattern coat was efficient in keeping static electricity to a minimum). The results can be found in Table 1, below.

Example 2

The coated abrasive of Example 2 was made and tested in the same manner as Example 1 except the cured electrically conductive ink stripes covered only 20% of the backing surface area. The results can be found in Table 1, below.

Example 3

The coated abrasive of Example 3 was made and tested in the same manner as Example 1 except "Dispersion II" was used in place of Dispersion I and the cured electrically conductive ink pattern covered about 50% of the backing surface area. Dispersion II consisted of 3462 grams of urea-formaldehyde resin, 225 grams of a 10% aqueous ammonium chloride solution, 146 grams of water and 4167 grams of a 18% solids aqueous carbon black dispersion. The carbon black dispersion was prepared according to the following steps:

a) adding 18 parts of a dispersing agent (commercially available from W. R. Grace & Co. of Lexington, Mass. under the trade designation "DAXAD 11G") to 61.2 parts water, while stirring;
b) adding 19.8 parts of the dispersing agent/water mixture prepared in step (a) to 601.1 parts water, while stirring;
c) adding 157.7 parts ethylene glycol monoethyl ether to the mixture from step (b), while stirring;
d) adding 40.5 parts of carbon black aggregates having a volatile content of 1.5 percent, a surface area of 254 $m^2/g$, and dibutyl phthalate absorption of 185 ml/100 g, and composed of carbon black particles having an average particle size of 35 nm (VULCAN XC-72R; Cabot Corp.; Boston, Mass.) to the mixture from step (c), while stirring;
e) repeating steps (b) and (c) 3 times, to provide a mixture comprising 662.3 parts water, 157.7 parts ethylene glycol monoethyl ether, 18 parts dispersing agent, and 162 parts carbon black.

The results can be found in Table 1, below.

Control Example A

The coated abrasive of Control Example A was made and tested in the same manner as Example 1 except it did not contain the cured electrically conductive ink coating. The results can be found in Table 1, below.

TABLE 1

| Example | Surface resistivity, kilo-ohms/square | Cut, grams | Dust collected, grams | DEF |
|---|---|---|---|---|
| 1 | <25 | 723 | 14 | 51.6 |
| 2 | <25 | 850 | 22 | 38.6 |
| 3 | <25 | 818 | 17 | 48.1 |
| Control A | >20,000 | 596 | 221 | 2.7 |

It can be seen from the above data, that the addition of the cured electrically conductive ink pattern coat significantly increased the cut and dramatically reduced the dust (swarf) accumulated.

Examples 4 to 6

Examples 4 through 6 illustrate various conductive ink pattern coatings. After the coatable electrically conductive ink (commercially available under the trade designation "AQUAFLEX ELECTROCONDUCTIVE BLACK OFG-10616" from Sinclair and Valentine, L. P. of Dayton, Ohio) was printed and cured, a coated abrasive was made according to the "Procedure for Making a Coated Abrasive" outlined in Example 1. The electrically conductive ink was cured by drying it in air.

The coated abrasives of these examples were tested as described in Example 1, except for the coated abrasive abraded six red oak workpieces for five minutes each instead of three for seven minutes each. The results can be found in Table 2, below.

Example 4

The cured electrically conductive ink pattern coat of the coated abrasive of Example 4 was a grid in which there was electrically conductive ink lines approximately 0.16 cm wide in the vertical and horizontal directions. The spacing between the cured electrically conductive ink lines was about 2.5 cm (1 inch). The coatable electrically conductive ink was printed via a letterpress process.

Example 5

The cured electrically conductive ink pattern coat of the coated abrasive of Example 5 was the same grid as Example 4, but in addition, coated characters such as "3M", "Dust Reduction", "TA3", "P150", "RB Pa F wt", were coated between the grid lines. These characters identified the product construction. Approximately 15% of the surface area of the backing was covered with the printed, cured electrically conductive ink.

Example 6

The uncured electrically conductive ink pattern coat of the coated abrasive of Example 6 was applied to the back side of the backing by using the inverse of a printing plate The printing plate consisted of characters such as "3M", "TA3", "P150", "Dust Reduction", "RB Pa F wt". These characters identified the product construction. Approximately 90% of the surface area was covered with the cured electrically conductive ink.

TABLE 2

| Example | Surface resistivity, kilo-ohms/sq. | Cut, grams | Dust collected, grams | DEF |
|---|---|---|---|---|
| 4 | <10 | 689 | 1.3 | 530 |
| 5 | <10 | 741 | 3.0 | 247 |
| 6 | <10 | 711 | 1.4 | 508 |
| Control A | >20,000 | 510 | 80.0 | 6.4 |

It can be seen from the above data, that the addition of the cured electrically conductive ink pattern coat on the back side of the abrasive article significantly increased the cut while dramatically reducing the dust (swarf) collected.

EXAMPLES 7-9

Example 7

The back side of a grade P150, open coat, F weight paper coated abrasive (commercially available under the trade designation "IMPERIAL" from 3M Company of St. Paul, Minn.) was printed with 2.5 cm (1 inch) diameter dots. The dots were applied by pushing the coatable electrically conductive ink by hand through a screen. The dots were about 3.5 cm apart (i.e., 6 cm apart from the center of one dot to the center of another dot). The dots covered approximately 22% of the backing surface area. The coatable electrically conductive ink was a silver-based ink, commercially available under the trade designation "ELECTRODAG 427SS", from Acheson Colloids Company of Port Huron, Mich. The electrically conductive ink was cured at about 93° C. (200° F.) for about 15 minutes.

The coated abrasive for Example 7 was tested as described in Example 1, except the red oak was sanded for 12 minutes instead of 7 minutes. The results can be found in Table 3, below.

Example 8

The back side of a grade P150, E weight paper coated abrasive (commercially available under the trade designation "241 THREE-M-ITE" from the 3M Company) was printed with a pattern of 2.5 cm (1 inch) diameter dots. The dots were applied by pushing the coatable electrically conductive ink by hand through a screen. The dots were about 1.3 cm apart (i.e., 3.9 cm apart from the center of one dot to the center of another dot). The dots covered approximately 34% of the backing surface area. The coatable electrically conductive ink was a graphite-based dispersion commercially available under the trade designation "AQUADAG E", from Acheson Colloids Company. The electrically conductive ink was cured by drying it in air. The coated abrasive was tested in the same manner as Example 7. The results can be found in Table 3, below.

TABLE 3

| Example | Surface resistivity, kilo-ohms/sq. | Cut, grams | Dust collected, grams | DEF |
|---|---|---|---|---|
| 7 | 0.0008 | 191 | 4 | 48 |
| 8 | 0.7 | 196 | 3 | 65 |
| Control B | >20,000 | 253 | 17 | 15 |
| Control C | >20,000 | 294 | 16 | 18 |

Control B was a grade P150, open coat, F weight paper coated abrasive (commercially available under the trade designation "IMPERIAL" from 3M Company) that did not have the cured electrically conductive ink coating.

Control C was a grade P150, E weight paper coated abrasive belt (commercially available under the trade designation "241 THREE-M-ITE" from 3M Company) that did not have the cured electrically conductive ink coating.

Example 9

The back side of a grade P150, open coat, F weight paper coated abrasive (commercially available under the trade designation "IMPERIAL" from 3M Company) was printed with 2.5 cm (1 inch) diameter dots. The dots were applied by pushing the coatable electrically conductive ink by hand through a screen. The dots covered approximately 37% of the surface area and were about 1.1 cm apart (i.e., 3.6 cm apart from the center of one dot to the center of another dot). The dots covered approximately 37% of the backing surface area. The coatable electrically conductive ink was a carbon black based ink commercially available under the trade designation "AQUAFLEX ELECTROCONDUCTIVE BLACK INK OFG-10616" from Sinclair and Valentine. The conductive ink was cured by drying it in air.

The coated abrasive was tested in the same manner as Example 7 except that pine was abraded instead of oak and for 15 minutes instead of 7 minutes. The results can be found in Table 4, below.

TABLE 4

| Example | Surface resistivity, kilo-ohms/sq | Cut, grams | Dust collected, grams | DEF |
|---|---|---|---|---|
| 9 | 5 | 307 | 22.5 | 13.6 |
| Control D | >20,000 | 268 | 102 | 2.6 |

Control D was a grade P150, open coat, F weight paper coated abrasive (as described for Control B).

EXAMPLES 10–12

Examples 10 to 12 illustrate the effectiveness of coated abrasive articles having the inventive non-continuous electrically conductive ink pattern coat on the top surface of the abrasive layer in reducing the buildup of static electricity during the abrading of electrically non-conductive workpieces.

Example 10

The top surface of a grade P150, open coat, F weight paper coated abrasive (commercially available under the trade designation "IMPERIAL" from 3M Company) was printed with 2.5 cm (1 inch) diameter dots. The dots were printed as described in Example 7. The dots covered approximately 50% of the surface area of the abrasive layer. The coatable electrically conductive ink was a graphite-carbon black-based ink, commercially available under the trade designation "ELECTRODAG 112" from Acheson Colloids Company. The electrically conductive ink was cured by air drying for 20 minutes.

The coated abrasive of Example 10 was tested as described in Example 1 except four red oak workpieces were each abraded for four minutes each. The results can be found in Table 5, below.

Example 11

The coated abrasive of Example 10 was prepared and tested as described in Example 11 except the coatable electrically conductive ink was a graphite-based dispersion, commercially available under the trade designation "AQUADAG E" for Acheson Colloids Company. The results can be found in Table 5, below.

TABLE 5

| Example | Surface resistivity, kilo-ohms/square | Cut, grams | Dust collected, grams | DEF |
|---|---|---|---|---|
| 10 | 10 | 368 | 16 | 23 |
| 11 | 0.6 | 507 | 24 | 21 |
| Control E | >20,000 | 563 | 40 | 14 |

Control E was a grade P150, open coat, F weight paper coated abrasive (as described for Control B).

Example 12

The top surface of a grade P150 , E weight paper coated abrasive (commercially available under the trade designation "241 THREE-M-ITE" FROM 3M COMPANY) was printed with 2.5 cm (1 inch) diameter dots as described in Example 10. A 20.3% aqueous zinc stearate solution was coated over the sizecoat having the cured electrically conductive ink coating. The zinc stearate supersize was cured by allowing it to dry in air.

The resulting coated abrasive was tested as described in Example 10. The results can be found in Table 6, below.

TABLE 6

| Example | Surface resistivity, kilo-ohms/square | Cut, grams | Dust collected, grams | DEF |
|---|---|---|---|---|
| 12 | 0.5 | 124 | 15 | 8.3 |
| Control F | >20,000 | 148 | 35 | 4.2 |

Control F was a grade P150, E weight paper coated abrasive (commercially available under the trade designation "241 THREE-M-ITE" from 3M Company).

It can be seen from the data in Tables 5 and 6 that the addition of the cured electrically conductive ink pattern coat on the top surface of the abrasive layer of the coated abrasive article significantly reduced the dust collected.

EXAMPLES 13–14

Examples 13 and 14 illustrate the effectiveness of coated abrasive articles having the inventive continuous electrically conductive ink coating on either the front surface or back surface of the backing in reducing the build-up of static electricity during the abrading of electrically non-conductive workpieces.

Example 13

The following coatable electrically conductive ink dispersion, hereinafter referred to as "Dispersion III", was prepared by thoroughly mixing 6165 grams of urea-formaldehyde resin (DURITE AL-8401), 7310 grams of carbon black dispersion (described in Example 3), and 555 grams of a 10% solution of aqueous ammonium chloride.

Dispersion III was applied to the back surface of an F weight backing by die coating to provide a continuous coating having an average wet add-on weight of about 2 to 2.5 g/m$^2$. The coated dispersion was dried for 2 minutes at 90° C., 2 minutes at 85° C., and 2 minutes at 90° C.

The surface resistivity of the cured electrically conductive ink was measured as described in Example 1. The surface resistivity value is reported in Table 7, below.

The F weight backing having the continuous coating of cured electrically conductive ink was used to make a coating abrasive belt using the procedures described in Example 1, except the make coat was precured for 15 minutes at 77° C., 30 minutes at 97° C., and 15 minutes at 101° C., and the size coat was cured for 90 minutes at 88° C. and 12 hours at 98° C., and after flexing and rehumidification, a zinc stearate supersize was applied (as described in Example 12).

The resulting coated abrasive was tested as described in Example 1 except one red oak workpiece was tested for 15 minutes. The results can be found in Table 7, below.

Example 14

The coat abrasive of Example 14 was made and testing in the same manner as Example 13 except the continuous coating of cured electrically conductive ink was applied to the front surface of the backing rather than the back surface. The results can be found in Table 7, below.

Control G was a coated abrasive prepared and tested in the same manner as Example 13 except it did not have the continuous coating of cured electrically conductive ink.

TABLE 7

| Example | Surface resistivity, kilo-ohms/sq. | Cut, grams | Dust collected, grams | DEF |
|---|---|---|---|---|
| 13 | 15 to 20 | 762 | 36 | 21.2 |
| 14 | 15 to 20 | 841 | 101 | 8.3 |
| Control G | >20,000 | 690 | 129 | 5.3 |

It can be seen from the data in Table 7 that the addition of a continuous coating of a cured electrically conductive ink to either the front or back surface of the backing significantly increased the cut and reduced the dust collected.

Various modifications and alterations of this invention will become apparent to those skilled in the art without departing from the scope and spirit of this invention, and it should be understood that this invention is not to be unduly limited to the illustrative embodiments set forth herein.

We claim:

1. A coated abrasive article with a reduced tendency to accumulate static electric charge during the abrading of an electrically insulating workpiece, said coated abrasive article having:

(a) a backing having a front surface and a back surface; and (b) an abrasive layer bonded to said front surface of the backing, said abrasive layer comprising abrasive grain and a layer(s) selected from the group consisting of a make layer and a size layer; a make layer, a size layer, and a supersize layer; a slurry layer; and a slurry layer and a supersize layer, wherein each of said make layer, said size layer, said slurry layer, and said supersize layer have a top surface, said improvement comprising at least one of (i) a pattern coating of a cured electrically conductive ink printed onto at least one of said back surface of said backing, said front surface of said backing, said top surface of said make layer, said top surface of said size layer, said top surface of said slurry layer, and said top surface of said supersize layer;

(ii) a continuous coating of electrically conductive ink printed onto said back surface of said backing; and (iii) a continues coating of electrically conductive ink printed onto said front surface of said backing, wherein areas of said pattern are non-continuous if said pattern is applied to said back surface of said backing or said front surface of said backing, otherwise said areas of said pattern are non-connected, said cured electrically conductive inks comprising a sufficient amount of electrically conductive material to reduce accumulation of static electric charge during said abrading of an electrically insulating workpiece, with the proviso that said amount of electrically conductive material in any single continuous coating of electrically conductive ink is less than 5 g/m$^2$.

2. The coated abrasive article according to claim 1 wherein said continuous coating is printed onto at least one of said front and back surface of said backing.

3. The coated abrasive article according to claim 1 wherein said pattern coating is printed onto at least one of said front and back surface of said backing.

4. The coated abrasive article according to claim 1 wherein said abrasive layer includes said slurry layer.

5. The coated abrasive article according to claim 4 wherein said pattern coating is printed onto said exposed top surface of said slurry layer.

6. The coated abrasive according to claim 1 wherein said abrasive layer includes said make layer and said size layer.

7. The coated abrasive according to claim 6 wherein said pattern coating is printed onto said top surface of said make layer.

8. The coated abrasive according to claim 6 wherein said pattern coating is printed onto said top surface of said size layer.

9. The coated abrasive according to claim 1 wherein said abrasive layer includes said supersize layer.

10. The coated abrasive article according to claim 9 wherein said pattern coating is printed onto said top surface of said supersize layer.

11. The coated abrasive article according to claim 1 wherein each of said pattern coatings of cured electrically conductive ink comprise less than 5 g/m$^2$ of said electrically conductive material.

12. The coated abrasive article according to claim 1 wherein each of said pattern coatings of cured electrically conductive ink comprise less than 3 g/m$^2$ of said electrically conductive material.

13. The coated abrasive article according to claim 1, wherein said coating of said cured electrically conductive ink has a surface resistivity of less than 5000 kilo-ohms/square.

14. The coated abrasive article according to claim 1, wherein said coating of said cured electrically conductive ink has a surface resistivity of less than 2000 kilo-ohms/square.

15. The coated abrasive article according to claim 1 wherein said electrically conductive material is selected from the group consisting of graphite, carbon black, metals, metal alloys, and mixtures thereof.

16. The coated abrasive article of claim 1 wherein said pattern coating is a repeating pattern which includes unprinted areas and printed areas.

17. The coated abrasive article of claim 1 wherein said pattern coating is a non-repeating pattern which includes unprinted areas and printed areas.

18. The coated abrasive article according to claim 1 wherein said cured electrically conductive ink comprises a cured polymeric medium selected from the group consisting of dried linseed oil, cured alkyd resins, cured phenolic resins, cured acrylate resins, dried glue, cured melamine formaldehyde resins, cured urea formaldehyde resins, cured epoxy resins, cured urethane resins, and mixtures thereof.

19. The coated abrasive article according to claim 1 wherein said backing is selected from the group consisting of paper, polymeric film, fiber, nonwoven fibrous material, cloth, treated versions thereof, and combinations thereof.

20. The coated abrasive article according to claim 1 wherein said abrasive grains are selected from the group consisting of fused aluminum oxide, ceramic aluminum oxide, cofused alumina-zirconia, silicon carbide, diamond, cubic boron nitride, garnet, heat-treated aluminum oxide, and mixtures thereof.

21. The coated abrasive article according to claim 1 having a continuous coating of said cured electrically conductive ink printed on said back surface of said backing and contrasting indicia printed over said continuous coating.

22. The coated abrasive article according to claim 1, said cured electrically conductive ink further comprising cured curable medium, wherein said electrically conductive material and said cured curable medium have a weight ratio of electrically conductive material to cured curable medium of greater than 1 to 10.

23. The coated abrasive article according to claim 1, said cured electrically conductive ink further comprising cured curable medium, wherein said electrically conductive material and said cured curable medium have a weight ratio of electrically conductive material to cured curable medium of greater than 1 to 1.

24. The coated abrasive article according to claim 1, said cured electrically conductive ink further comprising cured curable medium, wherein said electrically conductive material and said cured curable medium have a weight ratio of electrically conductive material to cured curable medium of greater than 4 to 1.

25. A method of making a coated abrasive with a reduced tendency to accumulate static electric charge during the abrading of an electrically insulating workpiece, said method having the steps of (a) selecting a backing having a front surface and a back surface; and (b) applying an abrasive layer to said front surface of said backing, said abrasive layer comprising abrasive grain and a layer(s) selected from the group consisting of a make layer and a size layer; a make layer, a size layer, and a supersize layer; a slurry layer; and a slurry layer and a supersize layer, wherein each of said make layer, said size layer, said slurry layer, and said supersize layer have a top surface, said improvement comprising (c) applying at least one of (i) a pattern of a coatable electrically conductive ink to at least one of said back surface of said backing, said front surface of said backing, said top surface of said make layer, said top surface of said size layer, said top surface of said slurry layer, and said top surface of said supersize layer;

(ii) a continuous coating of said coatable electrically conductive ink to said back surface of said backing; and (iii) a continuous coating of said coatable electrically conductive ink to said front surface of said backing, wherein areas of said pattern are non-continuous if said pattern is applied to said back surface of said backing or said front surface of said backing, otherwise said areas of said pattern are non-connected, and wherein said coatable electrically conductive ink comprises a sufficient amount of electrically conductive material to provide upon curing a coated abrasive article having a reduced tendency to accommodate static electric charge during the abrading of an electrically insulating workpiece; and (d) curing said electrically conductive inks to provide a coated abrasive having a reduced tendency to accumulate static electric charge during the abrading of an electrically insulating workpiece, with the proviso that said amount of electrically conductive material in any single continuous coating of electrically conductive ink is less than 5 $g/m^2$.

26. The method of claim 25 wherein said continuous coating is applied to at least one of said front and back surface of said backing.

27. The method of claim 25 wherein said pattern coating is applied to at least one of said front and back surface of said backing.

28. The method of claim 25 wherein said abrasive layer includes said slurry layer.

29. The method of claim 28 wherein said pattern coating is applied to said top surface of said slurry layer.

30. The method of claim 25 wherein said abrasive layer includes said make layer and said size layer.

31. The method of claim 30 wherein said pattern coating is applied to said top surface of said make layer.

32. The method of claim 30 wherein said pattern coating is applied to said top surface of said size layer.

33. The method of claim 25 wherein said abrasive layer includes said supersize layer.

34. The method of claim 33 wherein said pattern coating is applied onto said top surface of said supersize layer.

35. The method according to claim 25 wherein each of said printed pattern coatings of said cured electrically conductive ink comprise less than 5 $g/m^2$ of said electrically conductive material.

36. The method according to claim 25 wherein each of said printed pattern coatings of said cured electrically conductive ink comprise less than 3 $g/m^2$ of said electrically conductive material.

37. The method according to claim 25 wherein said cured electrically conductive ink has a surface resistivity of less than 5000 kilo-ohms/square.

38. The method according to claim 25 wherein said cured electrically conductive ink has a surface resistivity of less than 2000 kilo-ohms/square.

39. The method according to claim 25 wherein said electrically conductive material is selected from the group consisting of graphite, carbon black, metals, metal alloys, and mixtures thereof.

40. The method of claim 25 wherein said pattern coating is a repeating pattern which includes unprinted areas and printed areas.

41. The method of claim 25 wherein said pattern coating is a non-repeating pattern which includes unprinted and printed areas.

42. The method according to claim 25 wherein said continuous coating of said curable electrically conductive ink is applied to said back surface in step (c), and including the further step of (e) printing contrasting indicia over said continuous coating.

43. The method according to claim 25 wherein said coatable, curable electrically conductive ink further comprises curable medium having solids, wherein said electrically conductive material and coatable, curable medium have a weight ratio of electrically conductive material to said coatable, curable medium solids of greater than 1 to 10.

44. The method according to claim 25 wherein said coatable, curable electrically conductive ink comprises curable medium having solids, wherein said electrically conductive material and coatable, curable medium have a weight ratio of electrically conductive material to said coatable, curable medium solids of greater than 1 to 1.

45. The method according to claim 25 wherein said coatable, curable electrically conductive ink further comprises curable medium having solids, wherein said electrically conductive material and coatable, curable medium have a weight ratio of electrically conductive material to said coatable, curable medium solids of greater than 4 to 1.

* * * * *

UNITED STATES PATENT AND TRADEMARK OFFICE

CERTIFICATE OF CORRECTION

PATENT NO. : 5,137,542

DATED : August 11, 1992

INVENTOR(S) : Scott J. Buchanan and Kwo-Dong A. Chang

It is certified that error appears in the above-identified patent and that said Letters Patent is hereby corrected as shown below:

Column 2, line 48, "Which" should read --which--.

Column 9, line 23, "selt" should read --Belt--.

Column 12, line 43, "Provides" should read --provides--.

Column 19, line 57, "continues" should read --continuous--.

Signed and Sealed this

First Day of March, 1994

Bruce Lehman

*Attest:*

BRUCE LEHMAN

*Attesting Officer*

*Commissioner of Patents and Trademarks*